US011348558B2

(12) United States Patent
Meliti

(10) Patent No.: US 11,348,558 B2
(45) Date of Patent: May 31, 2022

(54) MONOLITHIC COMPOSITE DRUM SHELL

(71) Applicant: Michael G. Meliti, Southbury, CT (US)

(72) Inventor: Michael G. Meliti, Southbury, CT (US)

( * ) Notice: Subject to any disclaimer, the term of this patent is extended or adjusted under 35 U.S.C. 154(b) by 0 days.

(21) Appl. No.: 17/084,964

(22) Filed: Oct. 30, 2020

(65) Prior Publication Data

US 2021/0049986 A1 Feb. 18, 2021

Related U.S. Application Data

(63) Continuation of application No. 16/792,181, filed on Feb. 14, 2020, now Pat. No. 10,872,589.

(60) Provisional application No. 62/805,485, filed on Feb. 14, 2019.

(51) Int. Cl.

| | |
|---|---|
| ***G10D 13/22*** | (2020.01) |
| ***G10D 13/24*** | (2020.01) |
| *B27D 1/08* | (2006.01) |

(52) U.S. Cl.

CPC ..... *G10D 13/22* (2020.02); *G10D 13/24* (2020.02); *B27D 1/086* (2013.01); *B27K 2200/10* (2013.01)

(58) Field of Classification Search

CPC ..... G10D 13/22; G10D 13/24; G10D 13/02; B27K 2200/10; B27K 2200/15; B27K 3/0214; B27K 3/15; B27K 5/02; B27D 1/086; B27H 1/00

See application file for complete search history.

(56) References Cited

U.S. PATENT DOCUMENTS

| | | | | |
|---|---|---|---|---|
| 5,723,801 | A | 3/1998 | Hewitt | |
| 6,380,468 | B1 * | 4/2002 | Shigenaga | G10D 13/22 84/411 R |
| 2008/0193785 | A1 * | 8/2008 | Kingma | B05D 7/08 428/541 |

* cited by examiner

*Primary Examiner* — Kimberly R Lockett

(74) *Attorney, Agent, or Firm* — DeLio Peterson & Curcio LLC; Kelly M. Nowak

(57) ABSTRACT

Methods of making, and the resultant monolithic drum shell for a musical instrument, that include selecting one or more desired wood fibers, providing a resinous binder solution, and immersing the wood fibers within the resinous binder solution for a duration that saturates and covers the wood fibers with the resinous binder solution to form a drum shell liquid composition. The drum shell liquid composition is deposited into a mold, and then cured to form a monolithic composite drum shell. The monolithic composite drum shell is removed from the mold to provide a ready-to-use drum shell for assembling into a musical instrument.

19 Claims, 2 Drawing Sheets

MONOLITHIC COMPOSITE DRUM SHELL

CROSS-REFERENCE TO RELATED APPLICATIONS

This application is a Continuation of U.S. patent application Ser. No. 16/792,181 filed Feb. 14, 2020, which claims the benefit of U.S. Provisional Application Ser. No. 62/805,485, filed Feb. 14, 2019.

BACKGROUND OF THE INVENTION

1. Field of the Invention

The present invention relates generally to musical instruments and more specifically to monolithic composite drum shells and methods of making drum shells.

2. Description of Related Art

Drums are percussion instruments that are composed of a shell and a taut membrane that covers one or both ends of the shell. Drums are available in a variety of shapes and sizes including bowl-shaped (i.e., kettledrums) and tube/conical-shaped (i.e., conga drums). They can also be short (i.e., tubular drums) or shallow (i.e., snare, tenor and bass drums). Ultra-short drums are referred to frame drums (i.e., tambourine). A variety of different materials are used to make drums.

Materials used to form drum shells include wood, metal, and sometimes plastic. Wood drum shells are made from two-ply and/or three-ply plywood, while metal drum shells are made from steel (carbon), brass, aluminum, copper, bronze, titanium, and various metal alloys. Referring to wood drum shells, FIG. 1A shows the starting plywood 10 comprising several thin layers of wood sliced from the trunk of a tree in thin sheets. These thinly sliced layers of wood are laminated together to form plywood. Plywood is available in many different forms including oak, birch, beech, and maple.

In fabricating drum shells, several processing steps occur, beginning with selecting the desired type of plywood. One or more plywood sheets are adhered together to make the drum shell. For instance, drum shells are often made as six-ply to ten-ply plywood layers joined together. In a six-ply plywood, three (3) sheets of two-ply plywood are joined together whereby the middle plywood sheet is cut smaller than the two outer layers. The plywood layers are adhered together using an adhesive and a mold.

Referring to FIG. 1B, in forming plywood drum shells, first adhesive is applied to a first plywood layer, the plywood is bent 10, and then inserted into a warmed mold 12. The plywood is pressed tight to the mold, and then the second plywood layer is provided with adhesive, bent and inserted into the mold, and the process repeated for the third plywood layer. Once all plywood layers are provided in the mold, pressure is applied to such layers inside the mold, and the layers are allowed to dry. Drying is often performed by way of a microwave or air drying, but not within a heated oven as the dry heat of an oven deleteriously affects and damages the wood and adhesive. After the adhesive is fully dry, the formed drum shell 20 is removed from the mold (see FIG. 1C), top and bottom edges 16 must be cleaned trimmed and/or sanded, and then the drum shells 20 of the prior art is cut to a desired size.

It has been found that drum shells formed using these known techniques often have inconsistencies from one shell to the next. This is undesirable as these inconsistencies generate variable sound, or in some instances, the sound is completely compromised. Known approaches of forming drum shells are also time consuming requiring many fabrication steps and numerous layers of plywood, deplete natural resources, are expensive, and require intensive manual labor. Accordingly, there is a need in the art for new approaches of fabricating drum shells that are sustainable, quick to make, are reliable, generate consistent sound from resultant drum to drum, and are cost effective.

SUMMARY OF THE INVENTION

Bearing in mind the problems and deficiencies of the prior art, it is therefore an object of the present invention to provide monolithic composite drum shells that are sustainable, quick to make, are reliable, generate consistent sound from resultant drum to drum, and are cost effective.

It is another object of the present invention to provide methods of making monolithic composite drum shells that are sustainable, quick to make, are reliable, generate consistent sound from resultant drum to drum, and are cost effective.

Still other objects and advantages of the invention will in part be obvious and will in part be apparent from the specification.

The above and other objects, which will be apparent to those skilled in the art, are achieved in the present invention which is directed to a method of making a drum shell for a musical instrument. The method includes selecting one or more desired wood fibers, providing a resinous binder solution, and immersing the wood fibers within the resinous binder solution for a duration that saturates and covers the wood fibers with the resinous binder solution to form a drum shell liquid composition. The drum shell liquid composition is deposited into a mold, and then cured to form a monolithic composite drum shell. The monolithic composite drum shell is removed from the mold to provide a ready-to-use drum shell for assembling into a musical instrument.

In various embodiments the wood fibers may be recycled wood, recycled wood waste, wood chips, wood shavings, or sawdust, whereby each may be oak, birch, beech, maple, mahogany, walnut, cherry, bubinga, luana, poplar, ash, alder, pine, or spruce. The method may further include cleaning and drying the wood fibers prior to immersing within the resinous binder solution, and/or further include screening the wood fibers for desired particle sizes. The method may further include pretreating the wood fibers with an additive prior to immersing within the resinous binder solution. The additive may be a colorant, dye or coating.

The wood fibers may range in sizes from wood flour to wood chips. The resinous binder solution may be a polyester resin liquid, an epoxy resin liquid, or a polyurethane resin liquid in combination with a catalyzing agent. The polyester resin liquid may be mixed with a methyl ethyl ketone peroxide (MEKP) catalyst, such as, 0.5% to 2.0% MEKP with the remainder comprising the polyester resin liquid. The epoxy resin liquid may be mixed with an amine catalyst in a 1:1 ratio.

The monolithic composite drum shells may comprise contiguous solid structures devoid of openings. The step of immersing the wood fibers within the resinous binder solution fills openings and porous cavities within the wood fibers to avoid openings in the monolithic composite drum shell. The drum shell liquid composition may be, by volume, 30% to 80% of the wood fibers and the remainder being the resinous binder solution. The method may further include curing the drum shell liquid composition at a temperature ranging from ambient temperature up to 220° F., at pressures ranging from atmospheric pressure to 80 PSI, and durations ranging from approximately 1 hour to 24 hours.

Another aspect of the invention is directed to monolithic drum shells for a musical instrument made in accordance with the method of selecting one or more desired wood fibers, providing a resinous binder solution, and immersing the wood fibers within the resinous binder solution for a duration that saturates and covers the wood fibers with the resinous binder solution to form a drum shell liquid composition. The drum shell liquid composition is deposited into a mold, and then cured to form a monolithic composite drum shell. The resultant monolithic composite drum shell is removed from the mold to provide a ready-to-use drum shell for assembling into a musical instrument.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1A:
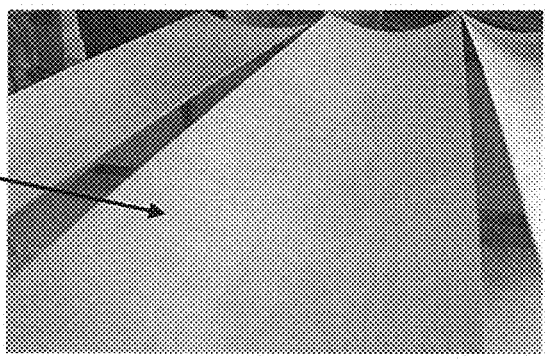
FIG. 1A PRIOR ART
FIG. 1A is a perspective view of plywood sheets for use in forming drum shells in accordance with the prior art.
Figure 1B:
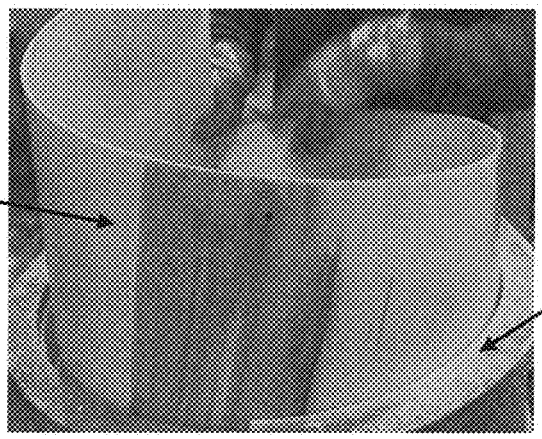
FIG. 1B PRIOR ART
FIG. 1B is a perspective view of the plywood of FIG. 1A provided in a mold for forming drum shells of the prior art.
Figure 1C:
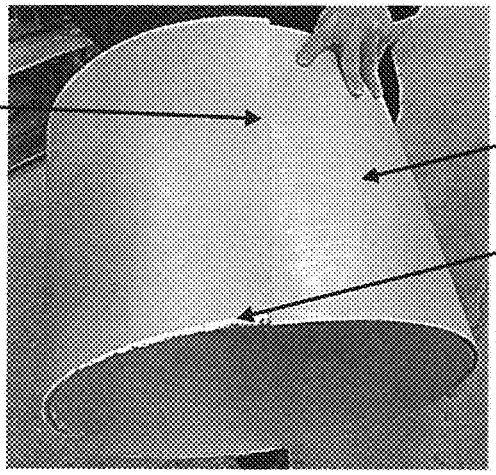
FIG. 1C PRIOR ART
FIG. 1C is a perspective view of the drum shell of FIG. 1B that must be cut and/or edges removed to form a resultant drum shell of the prior art.
Figure 2:
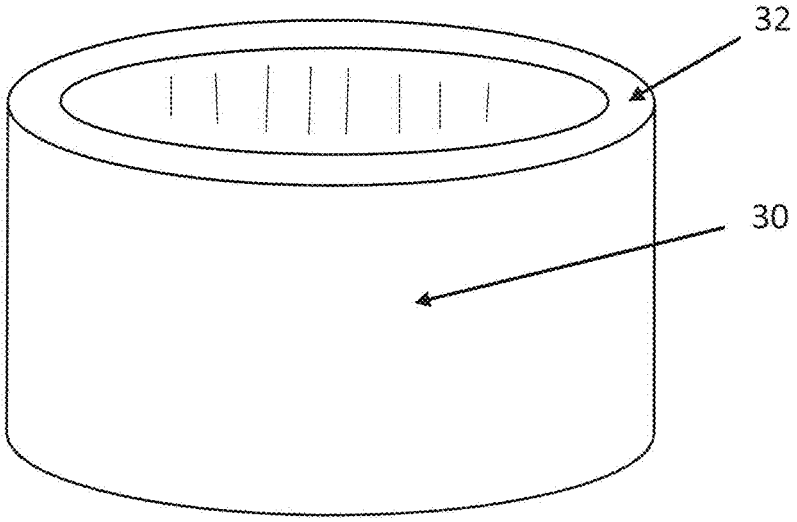
FIG. 2 is a perspective view of a monolithic composite drum shell in accordance with one or more embodiments of the invention.
Figure 3:
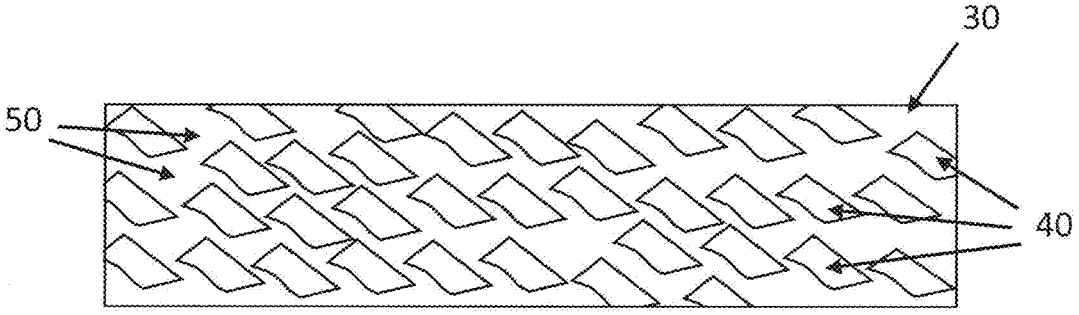
FIG. 3 is a cross-sectional side view of a monolithic composite drum shell in accordance with one or more embodiments of the invention.
Figure 4:
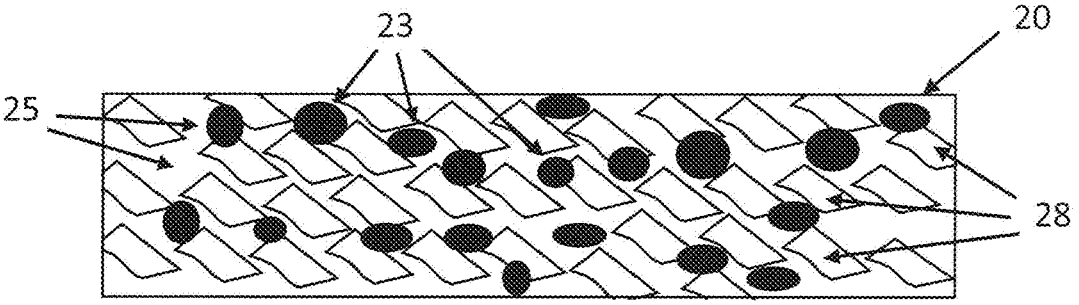
FIG. 4 PRIOR ART
FIG. 4 is a cross-sectional side view of a prior art drum shell having numerous gaps or openings therein which weaken the strength of the drum shell.

In describing the preferred embodiments of the present invention, reference will be made herein to FIGS. 1-4 of the drawings in which like numerals refer to like features of the invention.

A drum is a musical instrument that is composed of at least a drum shell having open opposing ends and a hollow body, whereby one or both open ends are covered with a membrane. The drum makes a sound by striking the membrane with a stick, mallet, hand, etc. so that the membrane vibrates up and down moving air within the drum shell, and off interior sidewalls thereof, to generate sound waves. While known drum shells are made of plywood, metal, and plastic, those composed of a wood material (e.g. plywood) are preferred by musicians. However, plywood drum shells are difficult and time consuming to make, and often generate inconsistent drum shells. Also, referring to FIG. 4 of the prior art, the prior art materials used to manufacture drum shells are often filled with openings 23 that undesirably weaken the resultant drum shell. As such, improved drum shells are needed that are consistent in quality, sound and reliability, efficient to make, and are cost effective.

The present invention provides an improved alternative to traditional wood drum shells for a musical instrument. In one or more embodiments, referring to FIG. 2 the invention is directed to monolithic (i.e., one-piece) composite drum shells 30. The monolithic drum shells 30 of the invention are fabricated using wood fibers 40 saturated in a solution of resin binder 50 to generate a composition suitable for molding. As compared to traditional drum shells 20, the one-piece molded drum shells 30 of the invention provide a sustainable and environmentally-friendly alternative to traditional drum shells, accelerate manufacturing, cost less to make, are formed without seams and undesirable openings therein, and provide consistent sound quality at an affordable price.

Referring to embodiments of the invention, the present monolithic composite drum shells may be made using any type of wood fibers 40 including, but not limited to, recycled wood, recycled wood waste, wood chips, wood shavings, sawdust, and the like. The types of wood used in the invention may also vary. Suitable wood for fabricating the various monolithic composite drum shells of the invention include, but are not limited to, oak, birch, beech, maple, mahogany, walnut, cherry, bubinga, luana, poplar, ash, alder, pine, spruce, and various other types of wood and wood materials.

In the invention, wood fibers are immersed in a resinous binder solution so that the entire surface area of the wood fibers are coated with the resinous binder. In one or more preferred embodiments the wood fibers are from recycled waste wood such as, for example, waste wood from shop-generated wood dust and particles. Suitable wood fiber sizes for use in the invention range from wood flour up to wood chips or wood fragments. As used herein, the term wood flour refers to finely pulverized wood that has a consistency equivalent to sand or sawdust, and may vary considerably, with particles ranging in dimensions from a fine powder to roughly that of a grain of rice. The wood chips or wood fragments may have dimensions up to ¼ of an inch, or more. In one or more embodiments, the wood fibers implemented in making the monolithic composite drum shells of the invention range from fine wood flour up to wood chips/fragments having coarse dimensions of approximately ¼ of an inch.

In one or more embodiments, prior to forming the monolithic composite drum shells of the invention the wood fibers may be cleaned, dried, screened and/or sorted for desired wood fiber sizes. For instance, the wood fibers may be washed in a bath, dried, and then processed through a screening machine to separate out wood fibers of desired size(s) in the final drum shells of the invention. Also, the present wood fibers may be pretreated with a material that provides desired attribute(s) or feature(s) to the resultant monolithic composite drum shells of the invention. For instance, the wood fibers may be pretreated with a colorant or dye, or covered with an aesthetic coating, to provide the resultant monolithic drum shell with a desired appearance.

Once the wood fibers have been selected, and optionally pretreated, the selected wood fibers are immersed in a bath of a resinous binder solution and mixed therein so that all surface areas of the wood fibers are thoroughly coated with the resin binder. In one or more embodiments, the wood fibers may even soak in the resin binder solution for a duration of about 30 minutes up to 1 or more hours to ensure all surface areas of the wood fibers are thoroughly wetted and coated. Depending upon the type of wood material used and amount of wood material, these soak times may vary in accordance with the invention. Soaking the wood fiber/material helps to avoid any openings 23 residing in the final resultant monolithic drum shell. Also, soaking and thoroughly wetting the surface areas of the wood fibers helps to ensure openings and porous cavities within the wood fibers are entirely filled with the resinous binder to avoid any openings 23 in the final drum shell 30.

In accordance with the invention, wood fibers are dispersed in a resinous binder solution that includes a polyester resin liquid, an epoxy resin liquid, a polyurethane resin liquid, and the like. Each of the polyester resin, epoxy resin and polyurethane resin liquids may be mixed with a suitable catalyzing agent (i.e. hardener) to initiate the chemical reaction of hardening the resinous binder solution and entrapping the wood fibers in a solid, continuous drum shell. In certain embodiments, the resinous binder solution may further include additives including, but not limited to, fillers, recycled plastic, glitter, colorants, dyes, and the like.

For instance, in one or more embodiments a polyester resin liquid may be mixed with a methyl ethyl ketone peroxide (MEKP) catalyst. In these embodiments the resinous binder solution may comprise a composition of 0.5% to 2.0% MEKP catalyst with the remainder being the polyester resin liquid. In other embodiments an epoxy resin liquid may be mixed with an amine catalyst (e.g., a primary amine, secondary amine, aliphatic amines, cyclo-aliphatic amines, etc.) in a 1:1 ratio (i.e., a two-part epoxy) for hardening the resinous binder solution. In embodiments implementing a polyurethane resin liquid and catalyst, it is preferred that the wood fibers are dried prior to mixing with the polyurethane resin mixture. The wood fibers may or may not be dried prior to mixing with the polyester resin and epoxy resin mixtures.

In forming the instant drum shells, the wood fibers are submerged or immersed in a predetermined amount of resinous binder solution as described below. In one or more embodiments the one-piece drum shells may be made using a drum shell liquid composition comprising, by volume, from 30% to 80% wood fiber with the remainder being the resinous binder solution. Depending upon the end use and desired sound generated from the resultant drum shell for a musical instrument, the amount by volume of wood fiber to resinous binder solution may vary. In various embodiments, the drum shell liquid compositions may have formulations by volume including, but not limited to, 30% wood fiber (e.g., wood dust or wood flour) to 70% resinous binder solution, 40% wood fiber to 60% resinous binder solution, 50% wood fiber to 50% resinous binder solution, 60% wood fiber to 40% resinous binder solution, 70% wood fiber to 30% resinous binder solution, 80% wood fiber to 20% resinous binder solution, and the like. In one or more preferred embodiments for sound quality, the monolithic drum shells of the invention contain, by volume, 30% to 80% recycled wood with the remainder being a polyester resin liquid, such as, a composition of 0.5% to 2.0% MEKP catalyst with the remainder being the polyester resin liquid.

In the various embodiments of the invention, the wood fibers used in the drum shell liquid compositions may be the same type of wood fiber, different types of wood fibers, wood fibers having the same dimensions (i.e., particle sizes), wood fibers having different dimensions, or any combination(s) of the foregoing. Once the drum shell liquid composition is formulated, and any soaking time has been completed, the liquid drum shell composition is deposited into a precast mold of a desired shape and size.

The mold is preferably a seamless mold (i.e., has no seams or gaps) such that the drum shell is formed as a one-piece (i.e., monolithic) structure. The liquid state drum shell composition may be poured (i.e., cast) into the mold, or it may be deposited into the mold by injection molding (i.e., shooting pressurized liquid state drum shell composition into the pre-made molds). As the liquid drum shell composition is deposited into the mold, it fills such mold and takes the shape thereof to generate the one-piece cast drum shells of the invention. The drum shell composition within the mold is then cured at a temperature ranging from ambient temperature up to 220° F., at pressures ranging from atmospheric pressure to 80 PSI, and durations ranging from approximately 1 hour to 24 hours.

After the drum shell composition is completely cured, the mold and cured monolithic drum shell are cooled, followed by removing the monolithic drum shell from the mold. In accordance with the invention, the various resultant monolithic drum shells comprise one-piece structures that require little to no post molding processing. For instance, since each drum shell is formed as a single complete drum shell unit, tasks including cutting, attaching layers together (e.g., plywood), finishing or fixing rough or incomplete edges, sanding to remove imperfections, etc. may be completely eliminated, or greatly minimized as compared to prior art drum shell 20 building techniques that require such post drum shell formation processing steps. The present monolithic drum shells are formed as uniform solid contiguous structures having no gaps or openings of wood fiber and resinous binder, whereby the cured resin binder fills any gaps and/or openings that otherwise would reside within such a structure.

Again, in the invention the wood fibers are soaked in the resinous binder solution(s) for a time that allows all surface areas of the wood fibers, including openings/voids/pores in the wood fibers, to be covered by, or filled with, the resinous binder solution. That is, unlike prior art techniques that merely spray a resinous solution onto a wood material, which results in openings 23 (e.g., holes, gaps, porous cavities, etc.) in the resultant end product (see, FIG. 4), the invention fills gaps and/or openings between and within wood fibers with the resin material to generate a solid contiguous drum shell product that is tightly-constructed.

It has been found that merely spraying the resin onto wood particles, followed by immediately forming such treated wood particles into a flat sheet, provides openings 23 within the drum shell 20. These openings 23 deleteriously affect performance and provide a product that is susceptible to damage (e.g., cracking, breaking, chipping, etc.). The openings 23 also decrease the strength of the prior art drum shells 20 that are composed of wood fibers 28 and an adhesive material that was sprayed onto such wood fibers 28. There is no guarantee that all surface areas of the wood fibers are coated by spraying or spray deposition, however, the instant invention ensures complete surface area coverage since the wood fibers are immersed, and optionally soaked, in a resinous binder solution.

The various monolithic drum shells of the invention may then be finished by attaching a membrane (surface area hit for drumming) to one or both open ends of the present monolithic drum shells, as well as attaching any necessary accessories (e.g., straps, feet, legs, handles, screws, metal rods, etc.) to provide a musical drum instrument of the invention. Since the molds used to form the present drum shells vary in diameter, length, shapes, and thickness, the resultant monolithic drum shells of the invention may likewise vary in diameter, length, shapes, and thickness.

In accordance with the various embodiments, the present drum shells are fabricated as ready-to-use drum shells (i.e., they are fabricated in the end use desired shape and size) for assembling into a musical instrument, as compared to prior art plywood sheets that are formed into sheets of material that must go through extensive processing to form a drum shell. In preferred embodiments the present drum shells do not require any cutting or trimming processing steps like that of prior art drum shells. They are also void of any openings 23 that would affect performance or weaken drum shell 30 strength. The present drum shells are also preferably formed without seams, as they are a one-piece structure, thereby avoiding any seam-related processing steps (e.g., gluing seams together, sanding, trimming, etc.). The monolithic drum shells of the invention are sustainable and consistent with regards to construction and sound quality.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

The invention claimed is:

1. A drum shell for a musical instrument comprising:

a monolithic drum shell comprising cured wood fibers saturated and covered with a resinous binder, the wood fibers present in an amount of 30% to 80% by volume and the remainder being the resinous binder, wherein the monolithic drum shell is a contiguous solid structure devoid of seams and is a ready-to-use one-piece molded drum shell for assembling into a musical instrument.

2. The drum shell of claim 1 wherein the wood fibers are selected from the group consisting of recycled wood, recycled wood waste, wood chips, wood shavings, and sawdust.

3. The drum shell of claim 1 wherein the wood fibers are selected from the group consisting of oak, birch, beech, maple, mahogany, walnut, cherry, bubinga, luana, poplar, ash, alder, pine, and spruce.

4. The drum shell of claim 1 wherein the wood fibers have a desired particle size and are cleaned prior to immersion into a resinous binder solution for saturating and covering the wood fibers.

5. The drum shell of claim 1 wherein the wood fibers comprise pretreated wood fibers having one or more additives.

6. The drum shell of claim 5 wherein the one or more additives comprise a colorant, dye or coating.

7. The drum shell of claim 1 wherein the wood fibers comprise recycled waste wood selected from wood dust or wood particles.

8. The drum shell of claim 1 wherein the wood fibers range in sizes from wood flour to wood chips.

9. The drum shell of claim 8 wherein the wood chips have dimensions up to ¼ of an inch.

10. The drum shell of claim 1 wherein the resinous binder comprises a polyester resin, an epoxy resin, or a polyurethane resin combined with a catalyzing agent.

11. The drum shell of claim 10 wherein the polyester resin is mixed with the catalyzing agent comprising a methyl ethyl ketone peroxide (MEKP) catalyst.

12. The drum shell of claim 10 wherein the epoxy resin is mixed with an amine catalyst in a 1:1 ratio.

13. The drum shell of claim 1 wherein the resinous binder further includes an additive selected from fillers, recycled plastic, glitter, colorants, dyes, or combinations thereof.

14. The drum shell of claim 1 wherein the monolithic composite drum shell is a contiguous solid structure devoid of openings or holes inside the monolithic drum shell.

15. The drum shell of claim 14 wherein openings and porous cavities within the wood fibers are entirely filled with the resinous binder to avoid the openings in the monolithic composite drum shell.

16. The drum shell of claim 1 wherein the monolithic drum shell comprises, by volume, 40% of the wood fibers to 60% of the resinous binder.

17. The drum shell of claim 1 wherein the monolithic drum shell comprises, by volume, 60% of the wood fibers to 40% of the resinous binder.

18. The drum shell of claim 1 wherein the monolithic drum shell has first and second open ends with a membrane attached to at least one of said first and second open ends.

19. A monolithic drum shell for a musical instrument comprising:

a cured one-piece molded drum shell comprising wood fibers saturated and entirely covered with a resinous binder, the wood fibers being present in an amount of 30% to 80%, by volume, with the remainder being the resinous binder, whereby the cured one-piece molded drum shell is a contiguous solid structure devoid of openings and seams, and is in a ready-to-use state for assembling into a musical instrument.

* * * * *